United States Patent [19]

Nomura

[11] Patent Number: 4,974,703

[45] Date of Patent: Dec. 4, 1990

[54] ELEVATOR CONTROL APPARATUS

[75] Inventor: Masami Nomura, Inazawa, Japan

[73] Assignee: Mitsubishi Denki Kabushikia Kaisha, Japan

[21] Appl. No.: 364,179

[22] Filed: Jun. 12, 1989

[30] Foreign Application Priority Data

Jun. 27, 1988 [JP] Japan ..... 63-158681

[51] Int. Cl.[5] ..... B66B 1/32

[52] U.S. Cl. ..... 187/108

[58] Field of Search ..... 187/108, 115

[56] References Cited

U.S. PATENT DOCUMENTS 4,340,131 7/1982 Eriksson ..... 187/108 X
4,368,501 1/1983 Gingrich ..... 187/108 X
4,739,969 4/1988 Eckersley et al. ..... 187/115 X

FOREIGN PATENT DOCUMENTS 59-48903 3/1984 Japan .

*Primary Examiner*—Philip H. Leung
*Assistant Examiner*—W. E. Duncanson, Jr.
*Attorney, Agent, or Firm*—Leydig, Voit & Mayer

[57] ABSTRACT

An elevator cage control apparatus includes a brake coil energized and deenergized by start and stop command signals to move and restrain the cage, respectively. A current detector detects current flowing through the brake coil. A counter counts a time interval beginning at generation of the stop command signal and ending when current in the brake control gradually decreasing increases instantaneously and a time interval beginning at generation of the start command signal and ending when current in the brake coil gradually increasing decreases instantaneously. A memory stores the counted time intervals. A drive command issuer commands a motor driving circuit to stop and start the cage, after the counted time intervals stored in the memory have lapsed, respectively.

1 Claim, 6 Drawing Sheets

ELEVATOR CONTROL APPARATUS

BACKGROUND OF THE INVENTION

This invention relates to an apparatus for controlling an elevator system, and more particularly to an elevator control apparatus which enhances the riding quality of a cage in the operation of starting or stopping the cage.

FIG. 5 shows a magnet type brake which is assembled so as to be unitary with a hoist.

Brake levers 50 are normally kept urged in directions indicated by arrows A, by means of springs 51. In consequence, brake shoes 52 grasp a brake wheel 53 to restrain the rotation thereof. The brake wheel 53 is compled to a rotary shaft 54 directly coupled to an electric motor, thereby to restrain the rotation of the motor and, in turn, the travel of a cage.

In addition, cams 55 each of which is formed in the shape of the letter L turn in directions indicated by arrows B with the A-directional movements of the brake levers 50, thereby to push a plunger 56 upwards.

When a brake coil 57 is energized, the plunger 56 is attracted to descend. With the descent, the plunger 56 turns the cams 55 in directions C, thereby to turn the brake levers 50 in directions D against the springs 51. As the brake levers 50 are turned, the brake shoes 52 release the braked wheel 53. Owing to the release, the rotary shaft 54 is driven by the motor so as to move the cage up or down.

A prior-art example of an elevator control apparatus employing the above brake will be explained with reference to FIG. 6. In the figure, numeral 1 designates a three-phase power source, and numeral 2 designates an electromagnetic contactor which opens and closes an electric contact from the A.C. power source 1 and which has a normally-open contact 2*a*. A drive circuit 3 for driving the motor 4 is configured of thyristors or transistors, and the motor 4 rotates the rotary shaft 54 so as to drive the cage 62 for ascent or descent. Shown at numeral 9 is an electromagnetic contactor which feeds the brake coil 57 with the voltage of a power source 10, and which has a normally-open contact 9*a*. A control circuit 11 is actuated by the closure of a start command contact 12 to energize the electromagnetic contactors 2 and 9 and to operate the drive circuit 3. Symbol $V_B$ denotes the voltage of a control power source for the control circuit 11. A sheave 60 is coupled to the rotary shaft 54 and has a main cable 61 wound there around, thereby to drive the cage 62 and a counterweight 63 for the ascent and descent in well-bucket fashion.

The above control apparatus for an elevator system operates as follows: When a call has arisen in the elevator system, the start command contact 12 is closed, and the control circuit 11 is actuated to energize the electromagnetic contactors 2 and 9. Thus, the contacts 2*a* and 9*a* are closed to feed electric power to the drive circuit 3 and to energize the brake coil 57 by means of the power source 10. Further, the control circuit 11 sends an operation command to the drive circuit 3, aiming at the timing at which current flows through the brake coil 57 to attract the plunger 56 and to consequently release the braked wheel 53, whereupon the drive circuit 3 supplies the electric power to the motor 4 so as to generate a torque for rotation. Owing to the torque, the cage 62 is smoothly started to ascend or descend.

Meanwhile, a diode 58 and a resistor 59 constitute a protective circuit which is usually disposed in order to protect the terminals of the coil 57 from dielectric breakdown and the contact 9*a* from burnout when the brake current has been cut off by the opening of the contact 9*a*.

Besides, the deceleration and stop of the cage 62 are controlled by the control circuit 11 and the drive circuit 3 until the rotational speed of the motor 4 becomes almost zero. When the motor speed has become zero, the contact 9*a* of the electromagnetic contactor 9 is opened so that the braking forces of the magnet brake may act.

Since the prior-art brake control apparatus for the elevator system is constructed and operated as stated above, the timing at which the brake coil is energized or deenergized for starting or stopping the cage and the timing at which the braking forces of the brake are actually released or exerted differ for every kind of elevator system and every site of installation, depending upon the clamped degrees of the brake springs, etc. Therefore, in such a case where the timing at which the braking forces of the brake are actually released and the timing at which the motor generates the torque do not match in the starting mode or where the timing at which the motor is decelerated and stopped by any other electrical means and the timing at which the braking forces of the brake are actually exerted do not match in the stopping mode, the riding quality of the cage in the starting or stopping mode is sometimes spoild.

SUMMARY OF THE INVENTION

This invention has been made in order to eliminate the problem as mentioned above, and has for its object to provide an elevator control apparatus in which the timing of issue of a start or stop command for an electric motor for driving a cage is set on the basis of the timing of deenergization or energization of a brake coil, thereby to offer an elevator operation having good riding characteristics.

An elevator control apparatus according to this invention consists in an elevator control apparatus wherein a brake coil is deenergized by a stop command signal so as to generate braking forces, thereby to control and restrain a cage, and the brake coil is energized by a start command signal so as to release the braking forces, thereby to control and move the cage; comprising a current detector which detects current flowing through said brake coil, count means for counting a time interval which is taken since generation of the stop command signal till an instantaneous increase of a current value in a process of gradual decrease in the brake coil current and a time interval which is taken since generation of the start command signal till an instantaneous decrease of a current value in a process of gradual increase in the brake coil current, a memory which stores the counted time intervals therein, and drive command issue means for issuing a motor stopping drive command to a motor driving circuit in stopping the cage and a motor starting drive command for starting the cage, after the counted time intervals stored in said memory have lapsed, respectively.

According to this invention, the time interval taken until the current value undergoes an instantaneous change since a time at which the current flowing through the brake coil for a plunger begins a steady change in the case of starting or stopping the cage is counted, the plunger functioning to hold brake shoes in pressed contact with a braked wheel which is held in engagement with the rotary shaft of the motor for driving the cage. The counted time interval is stored in the memory as a brake complete-release time interval or a braking completion time interval. In actually starting or stopping the cage, the drive command for the cage driving motor is issued upon the lapse of the stored counted time interval after a time at which a brake operation is started. Thus, the motor can smoothly operate the cage through a sheave without undergoing the action of a brake.

BRIEF DESCRIPTION OF THE DRAWINGS

Throughout the drawings, the same symbols indicate identical or equivalent portions.

DESCRIPTION OF THE PREFERRED EMBODIMENT

In general, the current and voltage of a brake coil 57 are related as follows:

$$E = \frac{d}{dt}(Li) + Ri \tag{1}$$

Here, letter E denotes the terminal voltage (constant in this case) of the brake coil 57, letter L the inductance thereof, and letter R the resistance thereof. In Eq. (1), the inductance L is constant before a plunger 56 operates. Therefore, the current i obtained from Eq. (1) is expressed by the following well-known formula:

$$i = \frac{E}{R}(1 - e^{-\frac{L}{R}t}) \tag{2}$$

Figure 4A:
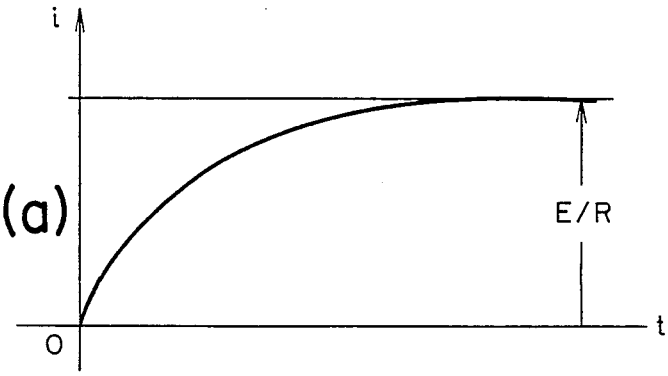
FIGS. 4(*a*)-4(*c*) are graphs of brake coil currents which flow when the brake coil is energized and deenergized.
Figure 4B:
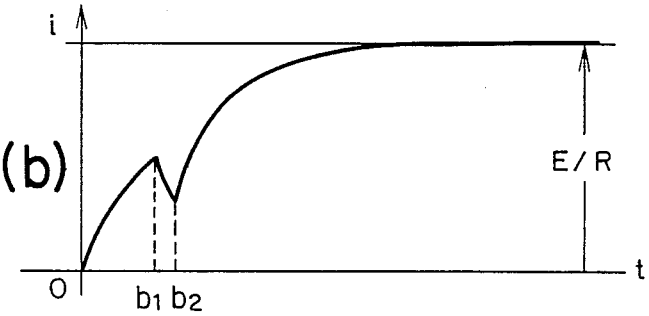
Figure 4C:
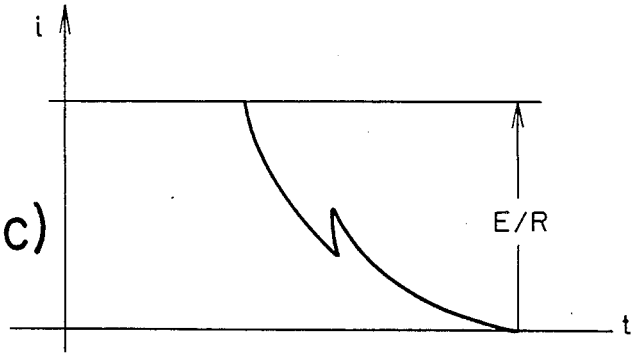
Figure 5:
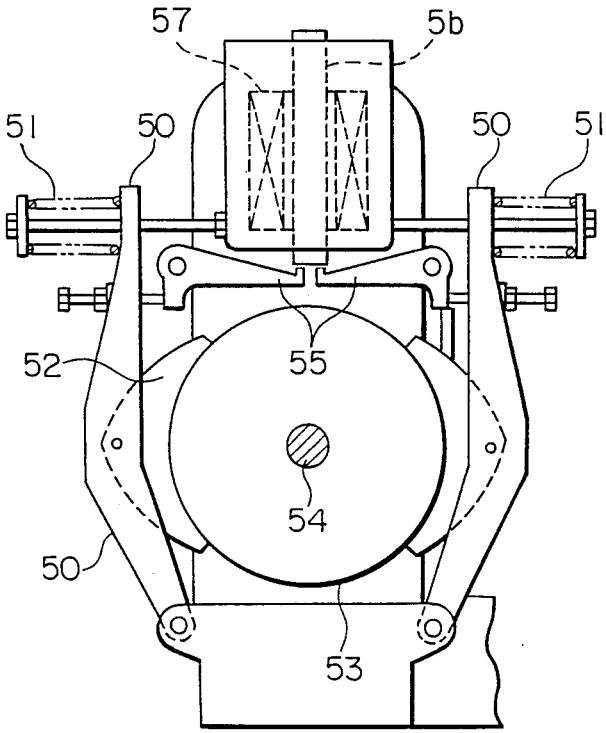
FIG. 5 PRIOR ART
FIG. 5 is a front view of a magnet brake.

The variation of this current versus the time t is as depicted in FIG. 4(*a*). In contrast, the inductance L changes when the brake coil 57 attracts the plunger 56 while overcoming springs 51. That is, Eq. (1) is reduced into:

$$E = \left(\frac{d}{dt}L\right)i + \left(\frac{d}{dt}i\right)L + Ri \tag{3}$$

Here, the differential term of the first term on the right-hand side of Eq. (3) can be rewritten as follows:

$$\frac{d}{dt}L = \frac{dx}{dt}\ \frac{d}{dx}L(x) \tag{4}$$

Here, letter x denotes the size of the air gap of the plunger 56, and symbol L(x) signifies that the inductance L is a function of the size x of the air gap.

Accordingly, $$\frac{dx}{dt}$$

denotes the moving speed of the plunger 56, and $$\frac{d}{dx}L(x)$$

denotes the variation rate of the inductance versus the variation of the air gap and becomes a minus value in this case. Thus, in the case where the plunger 56 is attracted, the variation of the current becomes as depicted in FIG. 4(*b*).

More specifically, the current i increases from a point 0 to a point $b_1$ in conformity with Eq. (1), and it decreases from the point $b_1$ to a point $b_2$ in conformity with Eqs. (3) and (4) during the process during which the plunger 56 is attracted. When the plunger 56 has been attracted, the current i gradually increases from the point $b_2$ in conformity with Eq. (1) in which the inductance L has a value corresponding to the attracted state of the plunger 56.

Accordingly, when the change of the current i shown in FIG. 4(*b*) is detected, it can be sensed that a magnet brake has been released.

Figure 6:
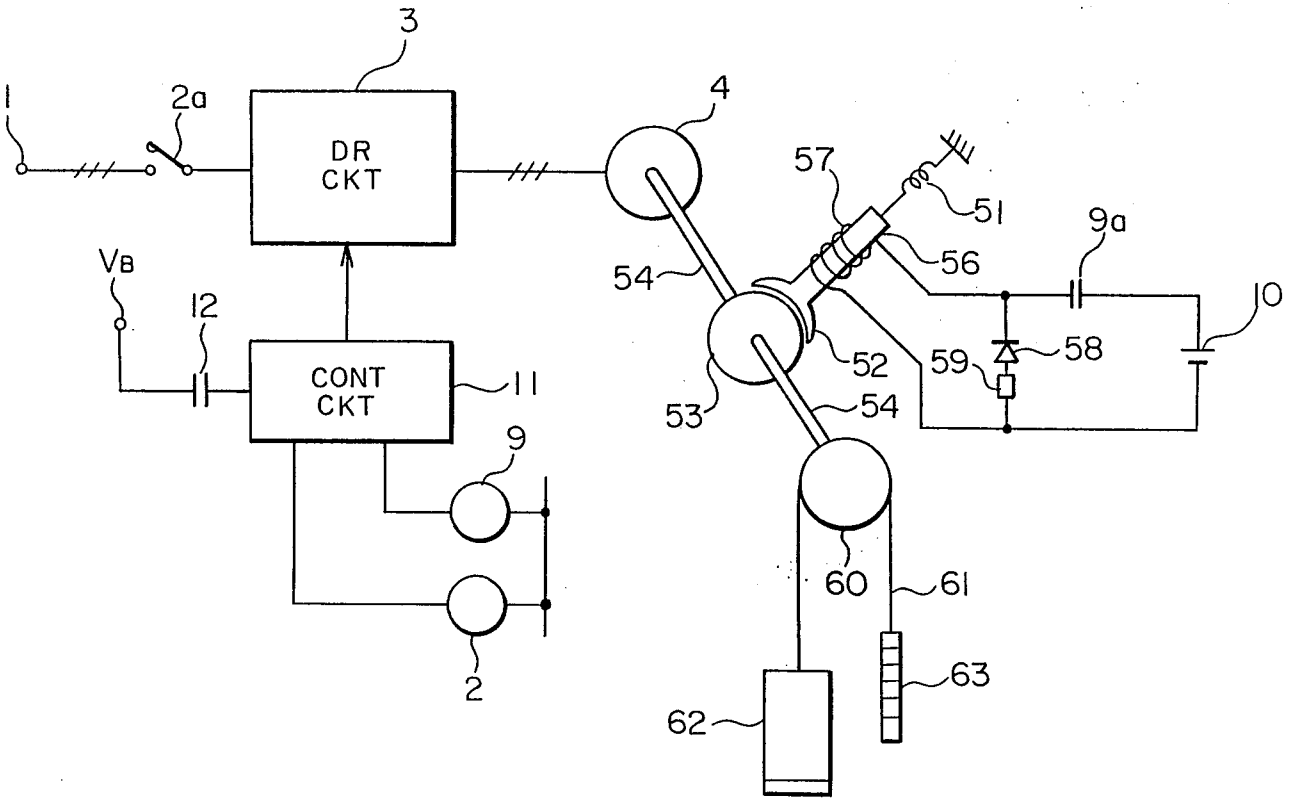
FIG. 6 PRIOR ART
FIG. 6 is a general arrangement diagram of a prior-art elevator control apparatus.

On the other hand, when the brake coil 57 is deenergized, the current thereof decreases while circulating through a diode 58. On this occasion, when the plunger 56 has moved upon the release of its attraction, the inductance value of the brake coil 57 changes to instantaneously increase the current thereof. As illustrated in FIG. 6, a resistor or/and a diode is/are usually connected in parallel with the brake coil 57 in order to protect this coil from the dielectric breakdown thereof at the cutoff of the current.

The variation of the current i in the case of deenergizing the brake coil 57 becomes as shown in FIG. 4(*c*).

Figure 1:
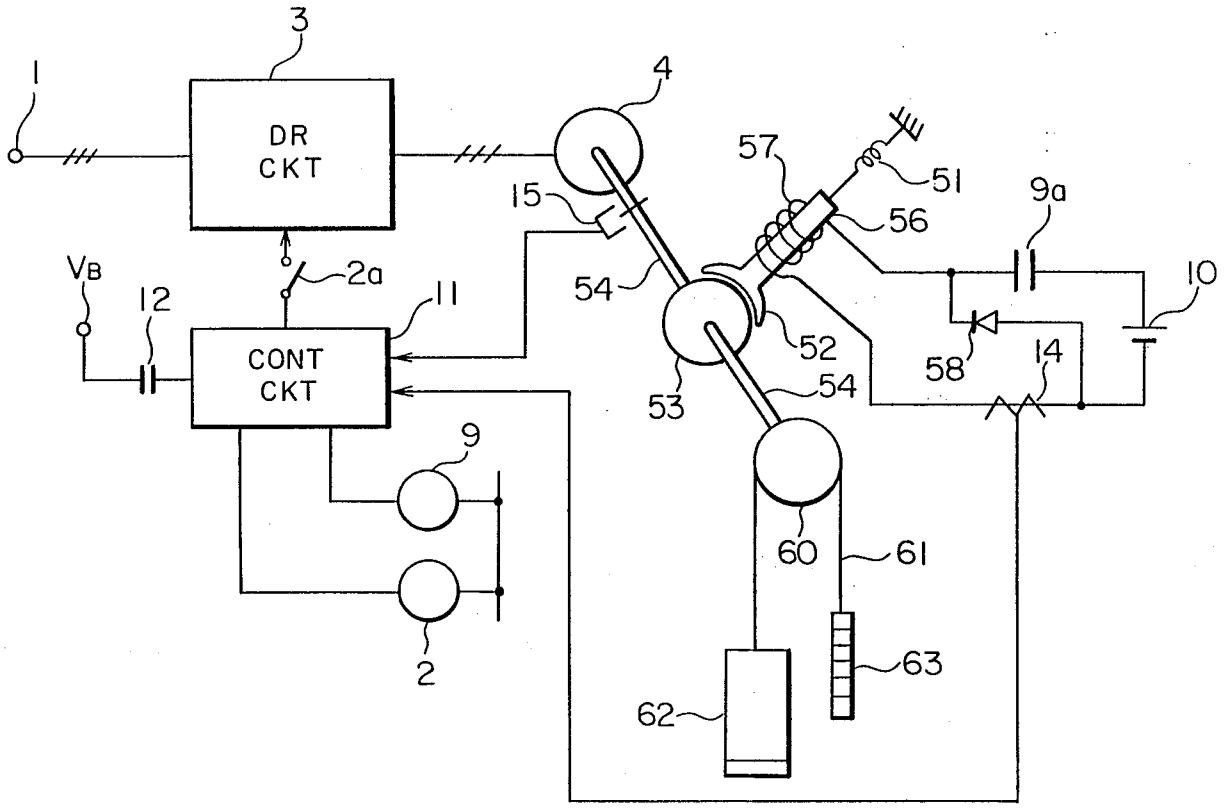
FIG. 1 is a general arrangement diagram of an elevator control apparatus according to this invention.

Now, an embodiment of this invention will be described with reference to the drawings. FIG. 1 is a general arrangement diagram of an elevator control apparatus according to this embodiment. In the figure, the same symbols as in FIG. 6 indicate identical or equivalent portions, and they shall not be described in detail. Referring to FIG. 1, symbol 2*a* denotes a switch which transmits a drive command from a control circuit 11 to a drive circuit 3. A current detector 14 detects a brake coil current, while a speed detector 15 detects a motor speed. A diode 58 serves to protect a brake coil 57 and a contact 9*a*.

Figure 2:
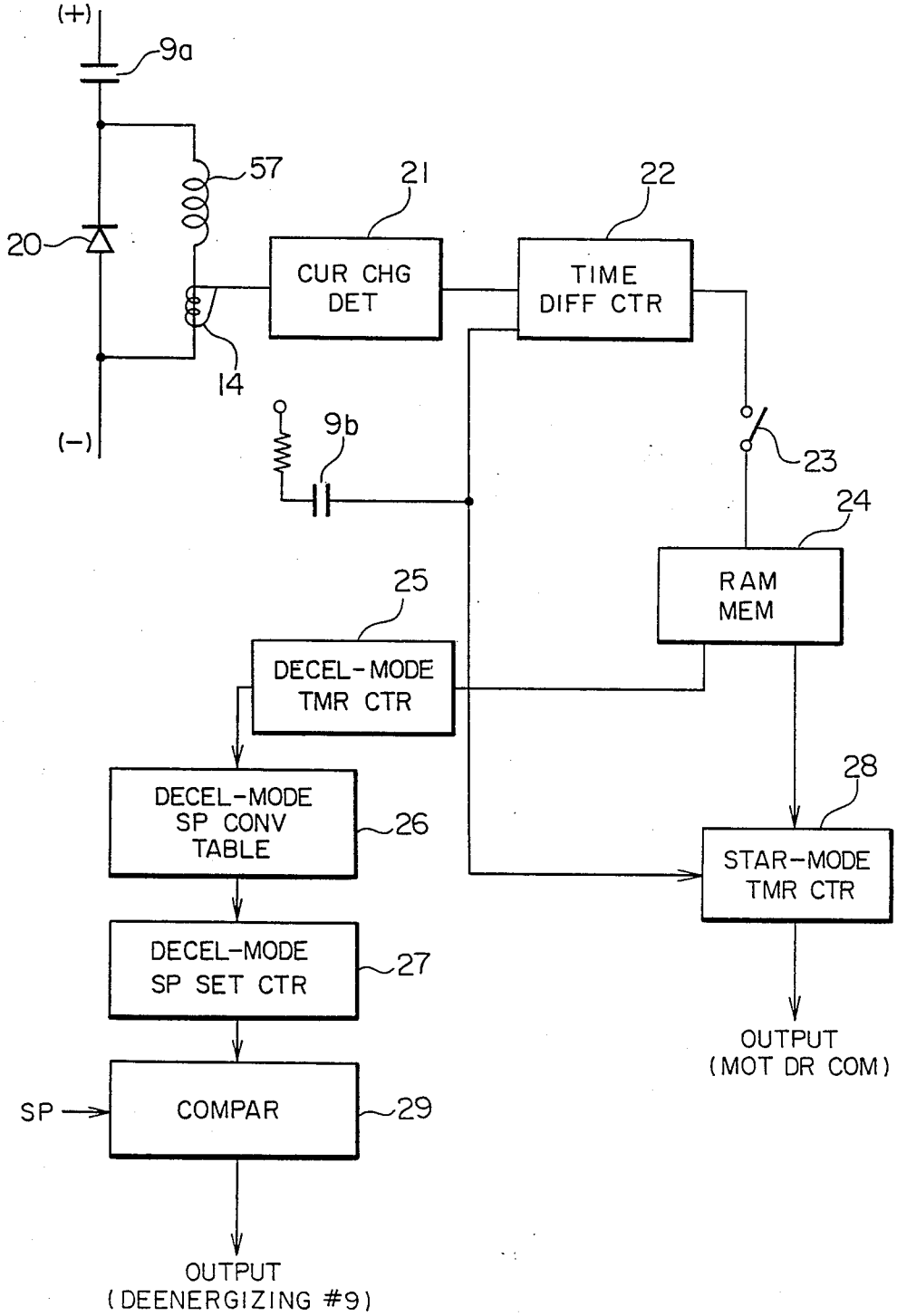
FIG. 2 is an internal block diagram of a control circuit (11) shown in FIG. 1.

FIG. 2 is a block diagram showing the internal arrangement of the control circuit 11 shown in FIG. 1 Referring to FIG. 2, symbol 9*b* denotes a contact which is opened and closed in interlocking relationship with the contact 9*a* for energizing and deenergizing the brake coil 57. A current change detector 21 detects the instantaneous change of the brake coil current, and produces a pulse signal as an output. A time difference counter 22 counts the difference between the point of time at which the contact 9*b* is opened or closed and the point of time at which the pulse signal of the current change detector 21 is produced. A manual switch 23 is closed by a manual operation so as to apply the count value of the time difference counter 22 as an input to a memory 24. A deceleration-mode timer counter 25 temporarily sets the count value of a decelerating and stopping operation as stored in the memory 24. A deceleration-mode speed conversion table 26 converts an actual time variation taken until an electric motor 4 has its speed rendered zero and stops, into a speed variation taken until the speed becomes zero, in accordance with a deceleration-mode speed curve which is preset by a speed command. A deceleration-mode speed setting counter 27 sets a time interval taken until the zero speed is reached, as the converted speed value. A comparator 29 compares the actual speed received from the speed detector 15 and the set count value, and it deenergizes an electromagnetic contactor 9 when the actual speed has become less than the set count value. A start-mode timer counter 28 issues a motor drive command when a set count value stored in the memory 24 has been reached in a starting operation.

Figure 3:
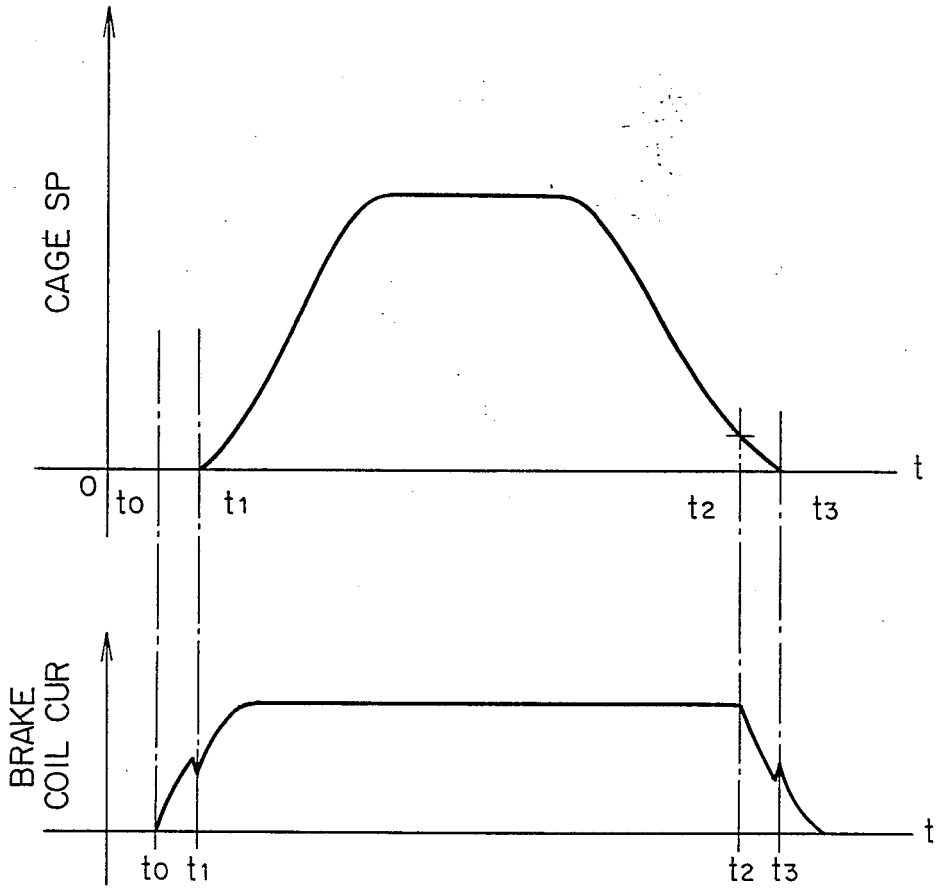
FIG. 3 is a graph showing the relationship between the speed of a cage and the current of a brake coil.

Next, the operation of this embodiment will be described on the basis of the above construction. The current change detector 21 detects each of the instantaneously decreasing change of the brake coil current in the process in which the current increases when the brake coil 57 is energized, and the instantaneously increasing change of the brake coil current in the process in which the current decreases when the brake coil 57 is deenergized, from the output of the current detector 14, and it generates the pulse when the instantaneous change has been detected. The pulse output is applied to the time difference counter 22, and this counter counts the time difference between the point of time of the generation of the pulse and the point of time of the opening or closing operation of the contact **9*b* which is opened and closed in interlocking relationship with the contact 9*a* for deenergizing and energizing the brake coil 57, respectively. Thus, the difference time interval from the point of time of the closure of the contact 9*b* to the point of time of the actual release of a magnet brake in the case of energizing the brake coil 57 and the difference time interval from the point of time of the opening of the contact 9*b* to the point of time of the actual braking of the magnet brake in the case of deenergizing the brake coil 57 are counted and are stored in the memory 24. When, in the state in which the time differences are stored in the memory 24, the start command contact 12 is closed in starting a cage 62, the brake coil energizing electromagnetic contactor 9 is energized to close the contacts 9*a* and 9*b* and to increase the brake coil current. Meanwhile, when the contact 9*b* is closed, the start-mode timer counter 28 operates to count for a predetermined time limit, the output of the control circuit 11 is applied to the drive circuit 3, and the drive circuit 3 operates to generate a driving force in the motor 4. At the same time that the driving force is generated in the motor 4, the brake is actually released, and the cage 62 begins its starting operation smoothly (point $t_1$ in FIG. 3**).

On the other hand, in the stopping operation in which the cage 62 approaches the predetermined position of a destination floor, this cage begins to decelerate and gradually decelerates in accordance with a speed command value. When the cage 62 travels below a predetermined speed, a brake release command is issued, the electromagnetic contactor 9 is deenergized to open the contacts **9*a* and 9*b*, and the brake coil current begins to decrease (point $t_2$ in FIG. 3). When the current becomes below a predetermined value, the plunger 56 operates, and the brake exerts a braking force. On this occasion, the motor 4 has been decelerated to approach a substantially zero speed. Therefore, the cage 62** is smoothly controlled continuously from the start to the stop by the electrical control operation.

Regarding the electrical control, in stopping the cage 62, the time interval taken after the opening of the contact **9*b* until the braking torques are actually exerted is once transferred from the memory 24 into the deceleration-mode timer counter 25. In the decelerating and stopping operation, the motor 4 is driven and controlled till the substantially zero speed by the drive circuit 3. It is therefore ideal that the brake exerts the actual braking torques when the motor speed has become zero. Since the speed curve during the deceleration is preset by the deceleration command, the speed of the cage 62 during the deceleration and a time interval taken till the stop of the cage 62 can be approximately predicted. Accordingly, the time interval till the stop versus the speed can be set by the deceleration-mode speed—time interval conversion table 26. A time interval in which the cage 62 just becomes the zero speed is evaluated by the table 26 in correspondence with the time interval which is taken since the opening of the contact 9*b* until the braking forces are actually exerted, and the obtained value is set in the deceleration-mode speed setting counter 27. The comparator 29 compares the set value and the actual speed, and it produces an output when the actual speed has become less than the set value of the deceleration-mode speed setting counter 27**, whereby the magnet brake is deenergized. In this way the controls with the operation delays of the brake taken into consideration are permitted in both the start mode and the stop mode, and a good riding quality is realized.

As described above, according to this invention, the time difference between the point of time at which a brake coil is energized or deenergized and the point of time at which brake torques are actually exerted or released is stored in a memory when an elevator system is installed or maintained, and in the ordinary operation of the elevator system, a starting torque is afforded to a motor in accordance with the time interval, while in stopping a cage, the brake coil is deenergized when the speed of the cage has become below a predetermined value. It is therefore possible to provide an elevator control apparatus which ensures a good riding quality.

What is claimed is:

1. An elevator control apparatus wherein a brake coil is deenergized by a stop command signal to generate a braking force to restrain a cage, and the brake coil is energized by a start command signal to release the braking force to move the cage, comprising:

a current detector which detects current flowing through said brake coil, count means for counting a time interval beginning at generation of the stop command signal and ending when current in the brake coil gradually decreasing increases instantaneously and a time interval beginning at generation of the start command signal and ending when current in the brake coil gradually increasing decreases instantaneously, a memory which stores the counted time intervals therein, and drive command issue means for issuing a motor stopping drive command to a motor driving circuit to stop the cage and a motor starting drive command thereto to start the cage, after the counted time intervals stored in said memory have lapsed, respectively.

* * * * *

UNITED STATES PATENT AND TRADEMARK OFFICE

CERTIFICATE OF CORRECTION

PATENT NO. : 4,974,703

DATED : December 4, 1990

INVENTOR(S) : Masami Nomura

It is certified that error appears in the above-identified patent and that said Letters Patent is hereby corrected as shown below:

In item [73] Assignee change "Mitsubishi Denki Kabushikia Kaisha" to -- Mitsubishi Denki Kabushiki Kaisha--.

In item [57] Abstract, line 7, change "control" to --coil--.

Signed and Sealed this

Twenty-sixth Day of May, 1992

*Attest:*

DOUGLAS B. COMER

*Attesting Officer*

*Acting Commissioner of Patents and Trademarks*